US010731650B2

(12) United States Patent
Ku et al.

(10) Patent No.: US 10,731,650 B2
(45) Date of Patent: Aug. 4, 2020

(54) ROTARY COMPRESSOR

(71) Applicant: LG ELECTRONICS INC., Seoul (KR)

(72) Inventors: Sejin Ku, Seoul (KR); Hyungjin Park, Seoul (KR); Sangmyung Byun, Seoul (KR); Gyeongsu Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 283 days.

(21) Appl. No.: 15/831,104

(22) Filed: Dec. 4, 2017

(65) Prior Publication Data

US 2018/0266423 A1 Sep. 20, 2018

(30) Foreign Application Priority Data

Mar. 15, 2017 (KR) ..... 10-2017-0032380

(51) Int. Cl.
*F04C 29/06* (2006.01)
*F04C 23/00* (2006.01)
*F04C 18/356* (2006.01)

(52) U.S. Cl.
CPC ..... *F04C 29/065* (2013.01); *F04C 18/3564* (2013.01); *F04C 23/008* (2013.01); *F04C 29/066* (2013.01)

(58) Field of Classification Search
CPC .. F04C 29/065; F04C 29/066; F04C 18/3564; F04C 23/008; F04B 39/0061; F04B 39/0066

(Continued)

(56) References Cited

U.S. PATENT DOCUMENTS 4,573,879 A * 3/1986 Uetuji ..... F04C 29/061 181/403
5,667,371 A * 9/1997 Prenger ..... F04C 18/0215 181/403

(Continued)

FOREIGN PATENT DOCUMENTS

CN 101331323 A 12/2008
CN 202789390 U 3/2013

(Continued)

OTHER PUBLICATIONS

Machine Translation of JP 2001-280241.*
Machine Translation of KR 10-2004-0097810.*

*Primary Examiner* — Christopher S Bobish
(74) *Attorney, Agent, or Firm* — Dentons US LLP

(57) ABSTRACT

A rotary compressor includes: a shell defining an internal space; a driving motor arranged in the internal space of the shell; and a compression mechanism unit to receive power of the driving motor and compress refrigerant, wherein the compression mechanism unit includes: a cylinder defining a chamber in which the refrigerant is compressed; a rotary shaft connected to the driving motor; a roller located in the chamber and connected to the rotary shaft to compress the refrigerant in the chamber while being rotated; a bearing coupled to the cylinder and having a discharge port through which the refrigerant compressed in the chamber passes; a muffler coupled to the bearing and into which the refrigerant passing through the discharge port is introduced; and a noise reducing unit fixed to the muffler to define a noise reducing chamber together with the muffler.

7 Claims, 9 Drawing Sheets

(58) Field of Classification Search
USPC ..... 417/902, 410.3
See application file for complete search history.

(56) References Cited

U.S. PATENT DOCUMENTS

| | | | | |
|---|---|---|---|---|
| 7,527,484 | B2 * | 5/2009 | Kim | F04C 18/0215 181/225 |
| 8,282,364 | B2 * | 10/2012 | Ogawa | F01C 21/104 417/312 |
| 8,430,648 | B2 * | 4/2013 | Kanayama | F01C 21/108 417/312 |
| 8,596,995 | B2 * | 12/2013 | Yuasa | F04C 18/3564 417/312 |
| 8,926,295 | B2 * | 1/2015 | Yanagisawa | F04B 35/04 417/410.3 |
| 9,951,775 | B2 * | 4/2018 | Katayama | F04C 29/066 |
| 10,436,199 | B2 * | 10/2019 | Morishita | F04C 27/001 |
| 2004/0241012 | A1 * | 12/2004 | Kim | F04C 29/065 417/312 |
| 2006/0056987 | A1 * | 3/2006 | Seok | F04C 18/3564 417/273 |
| 2006/0120894 | A1 * | 6/2006 | Shimizu | F01C 21/10 417/410.3 |
| 2012/0263615 | A1 * | 10/2012 | Iizuka | F04C 18/0215 418/55.3 |

FOREIGN PATENT DOCUMENTS

| | | | |
|---|---|---|---|
| EP | 1 967 737 | A1 | 9/2008 |
| EP | 1 967 738 | A1 | 9/2008 |
| JP | 60-240893 | A | 11/1985 |
| JP | 05-133376 | A | 5/1993 |
| JP | 07-259768 | A | 10/1995 |
| JP | 2001-280241 | A | 10/2001 |
| KR | 10-2004-0097810 | A | 11/2004 |
| KR | 10-2005-0062995 | A | 6/2005 |

* cited by examiner

ROTARY COMPRESSOR

CROSS-REFERENCE TO RELATED APPLICATIONS

This application claims priority under 35 U.S.C. 119 and 35 U.S.C. 365 to Korean Patent Application No. 10-2017-0032380 filed on Mar. 15, 2017 in Korea, the entire contents of which is hereby incorporated by reference in its entirety.

BACKGROUND

The present disclosure relates to a rotary compressor.

In general, a compressor is a machine that receives power from a power generating device such as an electric motor and a turbine and increases pressure by compressing air, refrigerant or various other operating gases, and has been widely used in home appliances such as a refrigerator and an air conditioner or throughout the industry.

Such a rotary compressor may be roughly classified into a reciprocating compressor, a rotary compressor and a scroll compressor.

The reciprocating compressor is a compressor in which a compression space through operating gas is sucked and discharged is defined between a piston and a cylinder and the piston linearly reciprocates inside the cylinder to compress refrigerant.

The rotary compressor is a compressor in which a compression space through which operating gas is sucked and discharged is defined between an eccentrically rotated roller and a cylinder and the roller is eccentrically rotated along an inner wall of the cylinder to compress refrigerant.

The scroll compressor is a compressor in which a compression space through which operating gas is sucked and discharged is defined between an orbiting scroll and a fixed scroll and the orbiting scroll is rotated along the fixed scroll to compress refrigerant.

Meanwhile, a discharge device for a rotary twin compressor is disclosed in Korean Patent Application Publication No. 10-2005-0062995 (2005 Jun. 28) which is the prior art.

The twin compressor disclosed in the prior art includes an airtight container, a compression mechanism unit and a motor mechanism unit.

The compression mechanism unit includes an upper bearing, a first cylinder, a second cylinder, a lower bearing and a middle plate.

Further, a first silencer configured to reduce discharge noise is mounted to an upper portion of the upper bearing and a second silencer configured to reduce the discharge noise is mounted to a lower portion of the lower bearing.

However, the twin compressor according to the prior art has a disadvantage in that because a silencer is mounted to each bearing, noise at some frequencies may be reduced but noise at various frequencies, which is generated by the compressor, may not be reduced.

SUMMARY

The present disclosure provides a rotary compressor in which a noise reducing effect is improved.

Further, present disclosure provides a rotary compressor in which a noise reducing structure may be formed through a simple structure.

A rotary compressor includes: a shell defining an internal space; a driving motor arranged in the internal space of the shell; and a compression mechanism unit configured to receive power of the driving motor and compress refrigerant, wherein the compression mechanism unit includes: a cylinder defining a chamber a chamber in which the refrigerant is compressed; a rotary shaft connected to the driving motor; a roller located in the chamber and connected to the rotary shaft to compress the refrigerant in the chamber while being rotated; a bearing coupled to the cylinder and having a discharge port through which the refrigerant compressed in the chamber passes; a muffler which is coupled to the bearing and into which the refrigerant passing through the discharge port is introduced; and a noise reducing unit fixed to the muffler to define a noise reducing chamber together with the muffler.

A rotary compressor includes: a shell defining an internal space; a driving motor arranged in the internal space of the shell; a rotary shaft configured to receive power of the driving motor and rotated; an upper cylinder through which the rotary shaft passes and which defines an upper chamber for compression of refrigerant; an upper roller located in the upper chamber and connected to the rotary shaft to compress refrigerant in the upper chamber while being rotated; a main bearing coupled to the upper cylinder and having a discharge port through which the refrigerant compressed in the upper chamber passes; an upper muffler which is coupled to the main bearing and into which the refrigerant passing through the discharge port is introduced; and a noise reducing unit fixed to an outer side of the upper muffler and defining a noise reducing chamber together with an upper surface of the upper muffler.

A rotary compressor includes: a shell defining an internal space; a driving motor arranged in the internal space of the shell; a rotary shaft configured to receive power of the driving motor to be rotated; an upper cylinder through which the rotary shaft passes and which defines an upper chamber for compression of refrigerant; an upper roller located in the upper chamber and connected to the rotary shaft to compress the refrigerant in the upper chamber while being rotated; a main bearing coupled to the upper cylinder and having a discharge port through which the refrigerant compressed in the upper chamber passes; an upper muffler which is coupled to the main bearing and into which the refrigerant passing through the discharge port is introduced; and a noise reducing unit located in an internal space of the upper muffler and defining a noise reducing chamber together with the upper muffler.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Hereinafter, a rotary compressor according to the present disclosure will be described in detail with reference to the accompanying drawings.

Figure 1:
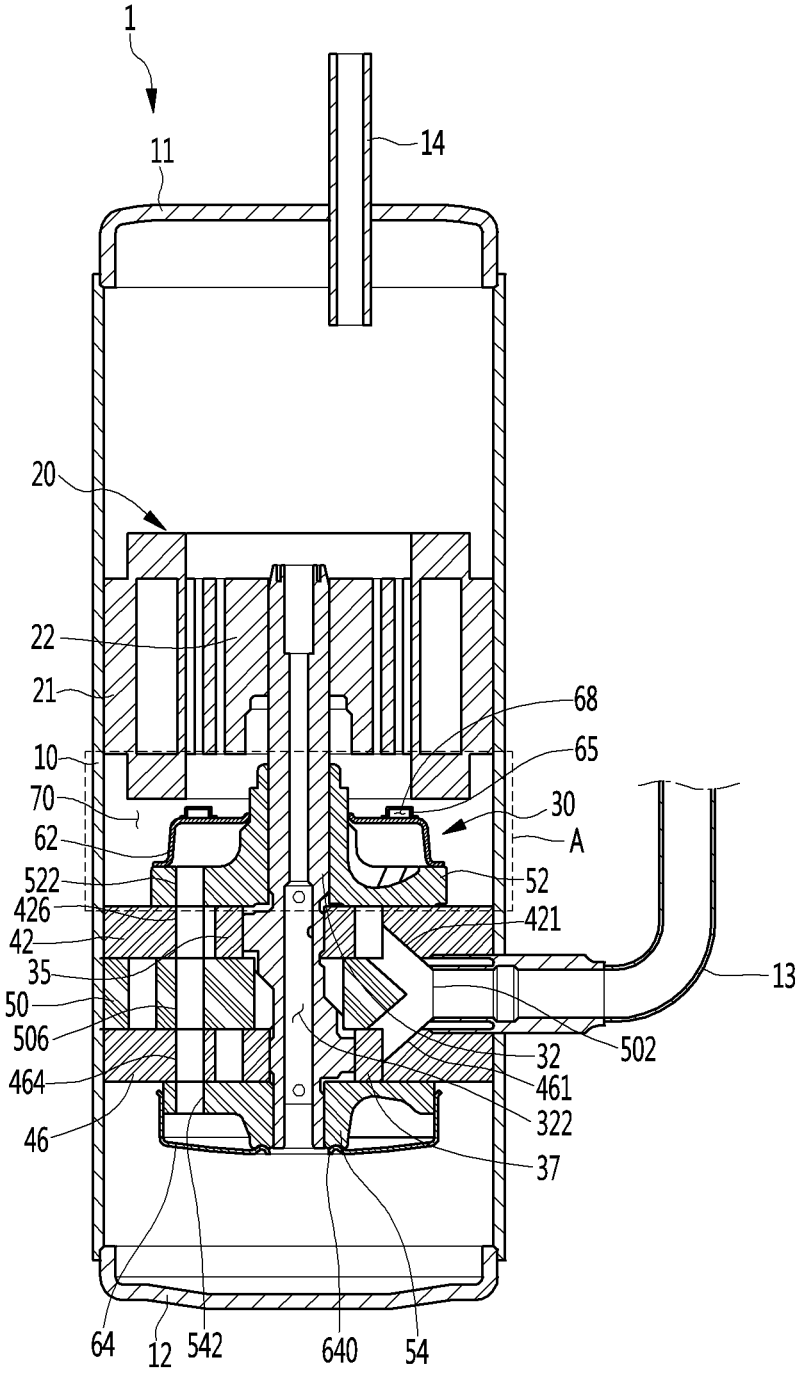
FIG. 1 is a sectional view illustrating a configuration of a rotary compressor according to a first embodiment of the present disclosure.
Figure 2:
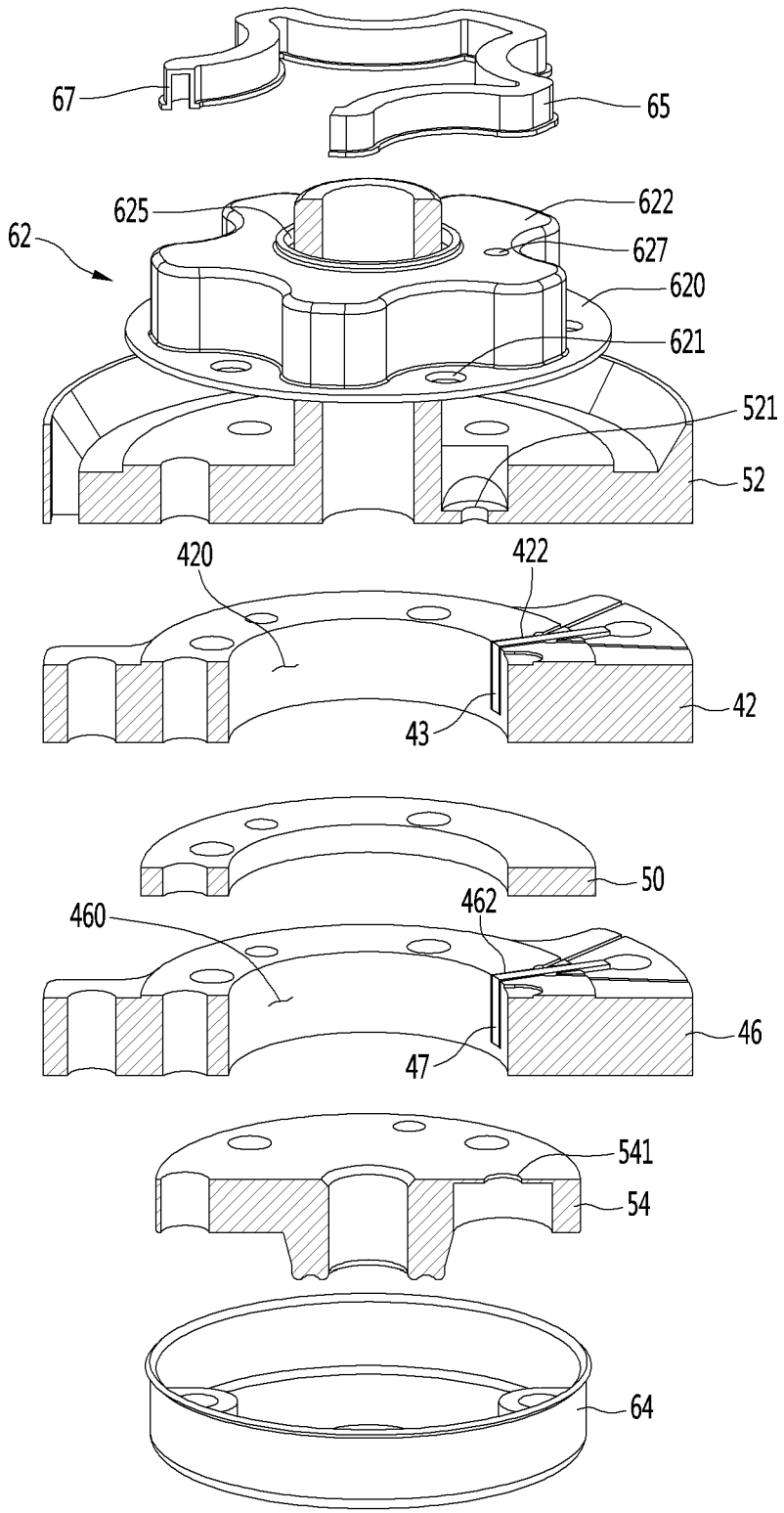
FIG. 2 is a perspective view illustrating a compression mechanism unit according to the first embodiment of the present disclosure.

FIG. 1 is a sectional view illustrating a configuration of a rotary compressor according to a first embodiment of the present disclosure, and FIG. 2 is a perspective view illustrating a compression mechanism unit according to the first embodiment of the present disclosure.

Referring to FIGS. 1 and 2, a rotary compressor 1 according to the first embodiment of the present disclosure may include a shell 10 defining an internal space, an upper cap 11 coupled to an upper portion of the shell 10, and a lower cap 12 coupled to a lower portion of the shell 10.

For example, the shell 10 may be formed to have a cylindrical shape. Further, the shell 10 may include an upper opening and a lower opening.

A portion of the upper cap 11 is formed to have a cylindrical shape and thus may be inserted into the shell 10 through the upper opening of the shell 10.

A portion of the lower cap 12 is formed to have a cylindrical shape and thus may be inserted into the shell 10 through the lower opening of the shell 10.

As another example, any one of the upper cap 11 and the lower cap 12 may be formed integrally with the shell 10.

A suction tube 13 may be connected to the shell 10 and a discharge tube 14 may be connected to the upper cap 14. However, in the present disclosure, connection locations of the suction tube 13 and the discharge tube 14 are not limited thereto.

The rotary compressor 1 may further include a driving motor 20 installed inside the shell 10 and a compression mechanism unit 30 connected to the driving motor 20 to compress refrigerant.

The driving motor 20 may include a stator 21 configured to generate magnetic force by applied electric power and a rotor 22 located inside the stator 21.

The stator 21 may be fixed to an inner peripheral surface of the shell 10. However, a portion of the stator 21 may be spaced apart from the inner peripheral surface of the shell such that oil may be vertically moved inside the shell 10 through the stator 21.

The rotor 22 may be rotated by induced electromotive force generated through interaction between the stator 21 and the rotor 22 while being located inside the stator 21.

The compression mechanism unit 30 may receive rotational force of the rotor 22 to compress the refrigerant. The compression mechanism unit 30 may be configured to compress the refrigerant in a single chamber or may be configured to compress the refrigerant in a plurality of chambers.

FIG. 1 illustrates an example of the compression mechanism unit 30 configured to perform compression in two chambers.

The compression mechanism unit 30 may include a rotary shaft 32 connected to the rotor 22 to transfer rotational force.

The rotary shaft 32 may vertically extend inside the shell 10. An oil passage 322 through which oil is to flow may be formed inside the rotary shaft 32. The oil passage 322 may vertically pass through the rotary shaft 32.

Further, although not illustrated, in the rotary shaft 32, branch passages configured to supply oil to chambers of cylinders, which will be described below, respectively, may be branched from the oil passage 322.

The compression mechanism unit 30 may include an upper compression unit and a lower compression unit.

Each of the upper compression unit and the lower compression unit may be connected to the rotary shaft 32. As described above, when the compression mechanism unit 30 performs compression in the single chamber, the compression mechanism unit 30 will include a single compression unit.

The upper compression unit may include an upper cylinder 42 defining an upper chamber 420 and an upper roller 35 located in the upper chamber 420 and connected to the rotary shaft 32.

The upper roller 35 may be eccentrically coupled to the rotary shaft 32, and may be rotated to have a constant eccentric trajectory according to rotation of the rotary shaft 32.

An upper vane slot 422 may be formed in the upper cylinder 42 and an upper vane 43 may be accommodated in the upper vane slot 422. The upper vane 43 divides the upper chamber 420 into a suction chamber and a compression chamber while reciprocating in the upper vane slot 422.

An upper refrigerant inlet 421 into which the refrigerant is introduced is formed in the upper cylinder 42. Although not restrictive, the upper refrigerant inlet 421 may inclinedly extend from a lower surface of the upper cylinder 42 toward the upper chamber 420.

The upper compression unit may further include a main bearing 52 positioned on the upper cylinder 42.

The main bearing 52 is fixed to the inner peripheral surface of the shell 10 and covers an upper side of the upper chamber 420. Them main bearing is located below the driving motor 20 to be spaced apart from the driving motor 20. A discharge port 521 through which the refrigerant compressed in the upper chamber 420 is discharged is formed in the main bearing 52.

The rotary shaft 32 passes through the main bearing 52 and is connected to the rotor 22. The main bearing 52 guides rotation such that the rotary shaft 32 is stably rotated without eccentricity.

An upper muffler 62 may be seated on the main bearing 52.

The upper muffler 62 may reduce noise generated while the compressed refrigerant is discharged from the upper chamber 420.

The rotary shaft 32 may pass through the upper muffler 62. A through-hole 625 through which the rotary shaft 32 is to pass may be formed in the upper muffler 62.

The lower compression unit may include a lower cylinder 46 defining a lower chamber 460 and a lower roller 37 located in the lower chamber 460 and connected to the rotary shaft 32.

The lower roller 37 may be eccentrically coupled to the rotary shaft 32, and may be rotated to have a constant eccentric trajectory according to the rotation of the rotary shaft 32.

A lower vane slot 462 may be provided in the lower cylinder 46 and a lower vane 47 may be accommodated in the lower vane slot 462.

The lower vane 47 divides the lower chamber 460 into a suction chamber and a compression chamber while reciprocating in the lower vane slot 462.

A lower refrigerant inlet 461 into which the refrigerant is introduced is formed in the lower cylinder 46. Although not restrictive, the upper refrigerant inlet 461 may inclinedly extend from a lower surface of the upper cylinder 46 toward the upper chamber 460.

Further, the lower cylinder 46 may further include a lower refrigerant outlet (not illustrated) through which the compressed refrigerant is discharged.

The lower compression unit may further include a sub bearing 54 located below the lower cylinder 46.

The sub bearing 54 may support the lower cylinder 46. Further, the sub bearing 54 may cover a lower side of the lower chamber 460.

The rotary shaft 32 may pass through the sub bearing 54. Thus, the sub bearing 54 guides rotation such that the rotary shaft 32 is stably rotated without eccentricity.

A discharge port 541 through which the refrigerant compressed in the lower chamber 460 passes is formed in the sub bearing 54.

A lower muffler 64 may be coupled to the sub bearing 54. The lower muffler 64 may reduce noise generated while the compressed refrigerant is discharged from the lower chamber 460.

An oil opening 640 through which the oil is to pass may be formed at a central portion of the lower muffler 64. The oil passage 322 of the rotary shaft 32 may communicate with the oil opening 640. Thus, the oil stored in the shell 10 may be supplied to the oil passage 322 of the rotary shaft 32 through the oil opening 640.

The compression mechanism unit 30 may further include a middle plate 50 located between the upper cylinder 42 and the lower cylinder 46.

The middle plate 50 may cover a lower side of the upper chamber 420 and an upper side of the lower chamber 460. By the middle plate 50, the upper roller 35 and the lower roller 37 are prevented from being directly rubbed against each other while the rotary shaft 32 is rotated.

The middle plate 50 may include a branch part 502 configured to branch the refrigerant sucked through the suction tube 13. The branch part 502 may communicate with the upper refrigerant inlet 421 and the lower refrigerant inlet 461.

Further, the rotary shaft 32 passes through the middle plate 50.

Meanwhile, the refrigerant compressed in the lower chamber 460 is discharged to an internal space of the lower muffler 64.

Further, the refrigerant discharged to the internal space of the lower muffler 64 flows to an internal space of the upper muffler 62 via the sub bearing 54, the lower cylinder 46, the middle plate 50, the upper cylinder 42 and the main bearing 52.

To achieve this, refrigerant passing openings 542, 464, 506, 426 and 522 through which the refrigerant is to pass may be provided in the sub bearing 54, the lower cylinder 46, the middle plate 50, the upper cylinder 42, and the main bearing 52, respectively.

The compression mechanism unit 30 may further include a noise reducing unit 65 disposed outside the upper muffler 62.

The noise reducing unit 65 is arranged outside the upper muffler 62 to move noise inside the upper muffler 62 along an inside of the noise reducing unit 65 so as to reduce the noise.

Of course, the refrigerant may be introduced into the noise reducing unit 65, and after the refrigerant introduced into the noise reducing unit 65 flows along the noise reducing unit 65, the refrigerant may be discharged to a space 70 (see area A in FIG. 1) between an outside of the upper muffler 62 and a lower surface of the driving motor 20 in the shell 10.

The noise reducing unit 65 may define a noise reducing chamber 68 together with the upper muffler 62 while being seated on an upper surface of the upper muffler 62.

While the noise reducing unit 65 is seated on the upper surface of the upper muffler 62, the noise reducing unit 65 may be spaced apart from the rotary shaft 32 passing through the upper muffler 62. In this case, to increase the length of the noise reducing chamber 68, the noise reducing unit 65 may be arranged to surround a circumference of the rotary shaft 32 while being spaced apart from the rotary shaft 32.

The upper muffler 62 may include a seating plate 620 seated on the upper bearing 52 and a chamber defining part 622 extending upward from the seating plate 620 and defining a predetermined space in an interior thereof.

Fastening holes 621 through which screws pass to achieve screw fastening to the upper bearing 52 may be provided in the seating plate 620.

The rotary shaft 32 may pass through the chamber defining part 622. Thus, the through hole 625 may be formed in the chamber defining part 622.

The noise reducing unit 65 may be fixed to an upper surface of the chamber defining part 622.

Hereinafter, a structure of the noise reducing unit 65 and a coupling relationship between the noise reducing unit 65 and the upper muffler 62 will be described.

Figure 3:
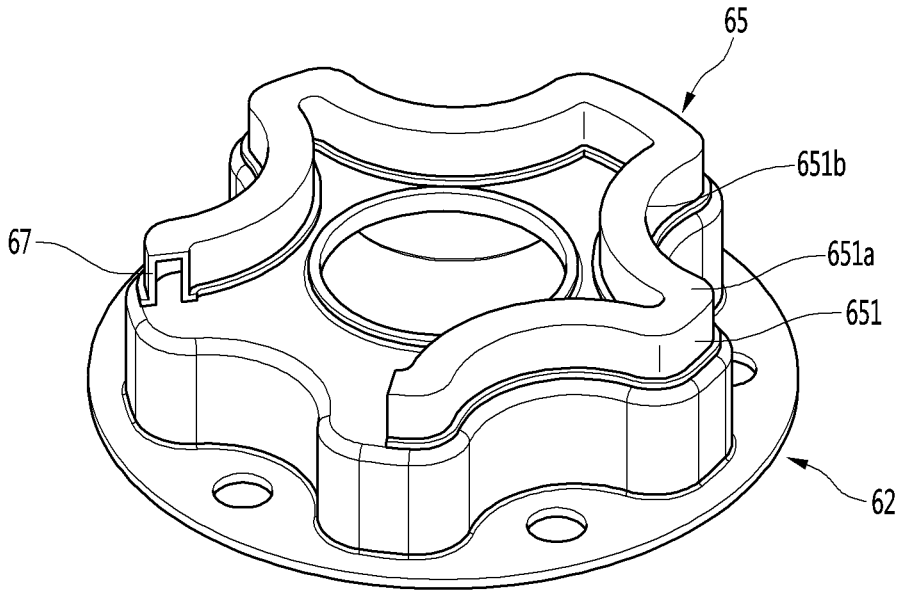
FIG. 3 is a view illustrating a state in which a noise reducing unit is fixed to an upper surface of an upper muffler according to the first embodiment of the present disclosure.
Figure 4:
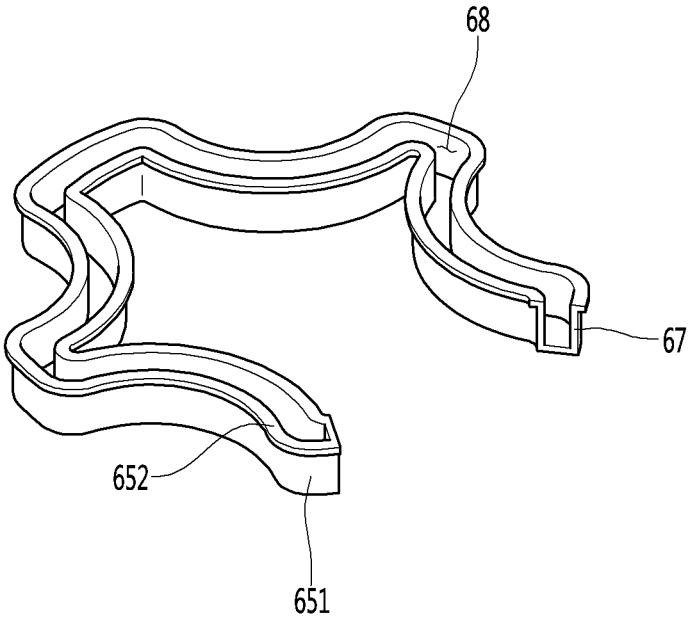
FIG. 4 is a perspective view illustrating a lower side of the noise reducing unit according to the first embodiment of the present disclosure.
Figure 5:
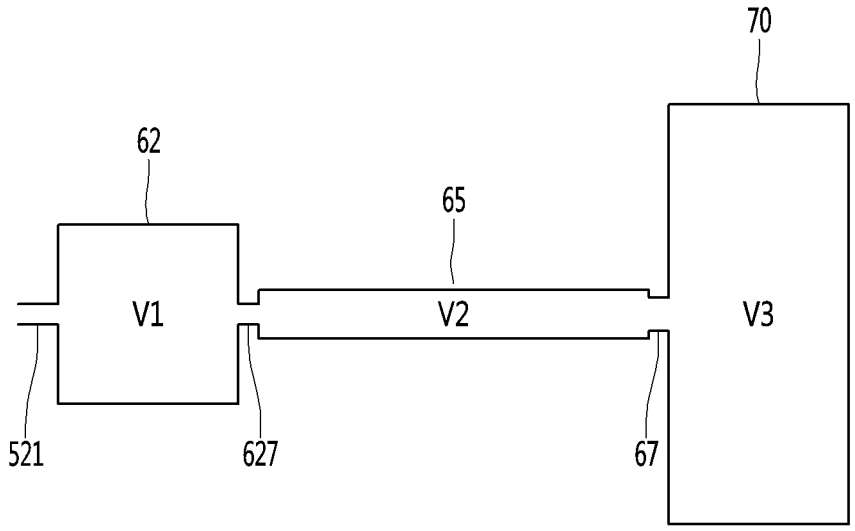
FIG. 5 is a view for explaining a principle of reducing noise by the upper muffler and the noise reducing unit according to the first embodiment of the present disclosure.

FIG. 3 is a view illustrating a state in which a noise reducing unit is fixed to an upper surface of an upper muffler according to the first embodiment of the present disclosure, FIG. 4 is a perspective view illustrating a lower side of the noise reducing unit according to the first embodiment of the present disclosure, and FIG. 5 is a view for explaining a principle of reducing noise by the upper muffler and the noise reducing unit according to the first embodiment of the present disclosure.

Referring to FIGS. 2 to 5, the noise reducing unit 65 may include a chamber defining body 651 defining the noise reducing chamber 68. The chamber defining body 651 may include opposite side surfaces and an upper surface. As an example, a vertical section of the chamber defining body 651 may have a shape of "n".

The chamber defining body 651 may include a plurality of curved parts when viewed from above such that the noise reducing chamber 68 is defined by the chamber defining body 651 and the upper surface of the chamber defining part 622 together even while the length of the noise reducing chamber 68 is increased. Although not restrictive, the chamber defining body 651 may include one or more convex parts 651*a* and one or more concave parts 651*b*.

As an example, the chamber defining body 651 may include a plurality of convex parts 651*a* and a plurality of concave parts 651*b*, and the convex parts 651*a* and the concave parts 651*b* may be alternately arranged.

Here, an increase in the length of the noise reducing chamber 68 implies an increase in the volume of the noise reducing chamber 68.

An extension part 652 transversely extending may be provided at a lower end of the chamber defining body 651. The extension part 652 may be welded to the upper surface of the upper muffler 62 while being in contact with the upper surface of the upper muffler 62. As an example, the extension part 652 may be point-welded to the upper surface of the upper muffler 62.

An opening 627 through which the noise is to be moved to the noise reducing chamber 68 is formed on the upper surface of the upper muffler 62.

Here, the diameter of the opening 627 may be smaller than a transverse width of the vertical section of the noise reducing chamber 68.

The chamber defining body 651 may include an outlet 67 through which the refrigerant introduced into the noise reducing chamber 68 is to be discharged. The outlet 67 may be formed on a lateral surface of the chamber defining body 651, or unlike this, may be formed on an upper surface of the chamber defining body 651.

In this case, one or more outlets through the refrigerant is directly discharged to an inside of the shell 10 while being not introduced into the noise reducing chamber 68 may be provided in the upper muffler 62.

In the present embodiment, the discharge port 521 of the upper bearing 52 and the internal space (volume V1) of the upper muffler 62 serve as a first resonator.

Further, the opening 627 of the upper muffler 62 and the noise reducing unit 65 (volume V2) serve as a second resonator.

Further, the outlet 67 of the noise reducing unit 65 and the space 70 (volume V3) between the outer surface of the upper muffler 62 and the lower surface of the driving motor 20 in the shell 10 serve as a third resonator.

That is, the discharge port 521, the opening 627, and the outlet 67 of the noise reducing unit 65 serve as neck parts of the resonators, respectively, and the internal space of the upper muffler 62, the noise reducing chamber 68, and the internal space 70 of the shell 10 serve as volume parts of the resonators, respectively.

In the present disclosure, the first resonator to the third resonator may be designed to reduce noise having different frequency bands.

In general, the frequencies of the noise reduced by the resonators are decreased as the lengths of the neck parts become larger, the volumes of the volume parts become larger, and the cross-sectional areas (diameters) of the neck parts become larger.

As an example, the vertical section of the noise reducing chamber 68 may be larger than the cross-sectional area of the discharge port 521.

The length of the first discharge port 521 may be larger than the length of the opening 627. Further, the volume V1 of the internal space of the upper muffler 62 may be larger than the volume V2 of the noise reducing chamber 68.

Thus, the frequency band of the noise reduced by the second resonator may be larger than the frequency band of the noise reduced by the first resonator.

Meanwhile, the area of the outlet 67 of the noise reducing unit 65 is larger than the area of the opening 627 and the area of the discharge port 521. On the other hand, the volume V3 of the internal space 70 of the shell 10 is larger than the volume V1 of the internal space of the upper muffler 62 and the volume V2 of the noise reducing chamber 68.

In this case, a value obtained by dividing the area of the outlet 67 of the noise reducing unit 65 by the volume V3 of the internal space 70 of the shell 10 is remarkably smaller than a value obtained by dividing the area of the discharge port 521 by the volume V1 of the internal space of the upper muffler 62 and a value obtained by dividing the area of the opening 627 by the volume V2 of the noise reducing chamber 68.

The frequency band of the noise reduced by the third resonator is smaller than the frequency bands of the noise reduced by the first resonator and the second resonator.

According to the present disclosure, the noise reducing unit is provided, so that there is an advantage in that noise having a frequency band that is lower than the frequency band of noise reduced by the upper muffler as well as noise having a frequency band that is higher than the frequency band of the noise reduced by the upper muffler are reduced.

In the present disclosure, the frequency band of the noise reduced by the second resonator may be determined by the length and the inner diameter of the noise reducing unit 65.

According to the present disclosure, the resonators may be formed by designing the length of the noise reducing unit 65 and the cross-sectional area of the noise reducing chamber 68 without changing structures of other parts of the conventional compressor, and then coupling the noise reducing unit 65 and the noise reducing chamber 68 to the upper muffler 62. Thus, according to the present disclosure, the resonators for reducing noise may be formed without a change of the existing structure.

In particular, because the internal space of the shell serves as the volume part, an effect that two additional resonators are provided in the resonator is obtained by the upper muffler when the noise reducing unit is coupled to the upper muffler. Thus, there is an advantage in that the plurality of resonators may be formed through a simple structure.

Figure 6:
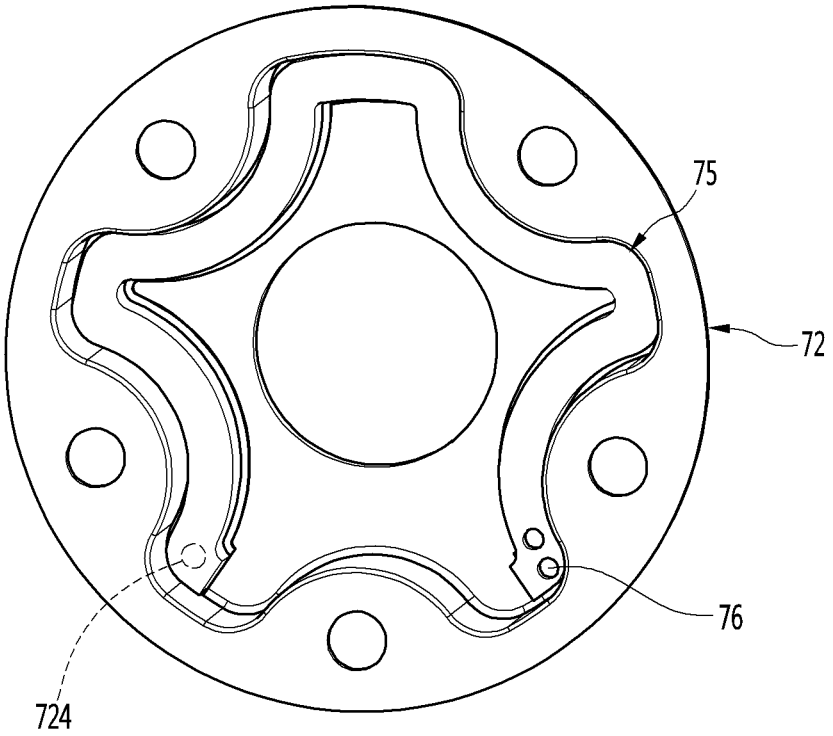
FIG. 6 is a perspective view illustrating a state in which a noise reducing unit is installed inside an upper muffler according to a second embodiment of the present disclosure.
Figure 7:
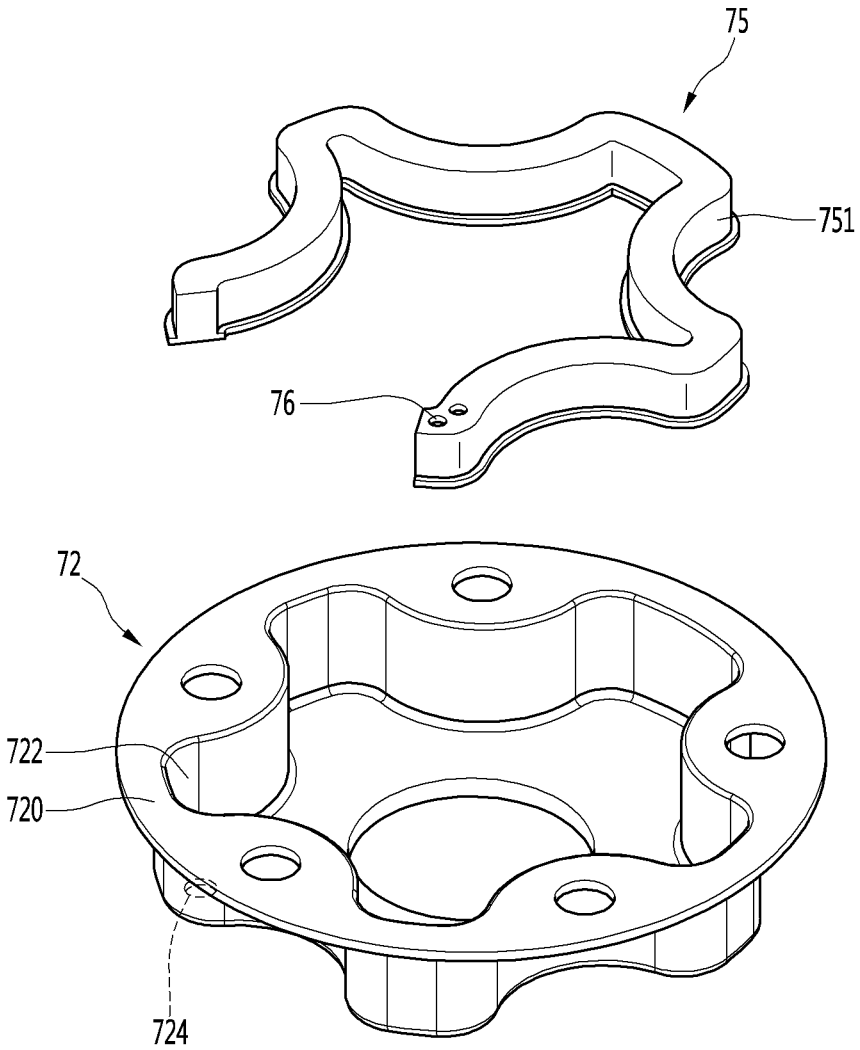
FIG. 7 is a view illustrating a state in which the noise reducing unit of FIG. 6 is separated from the upper muffler.
Figure 8:
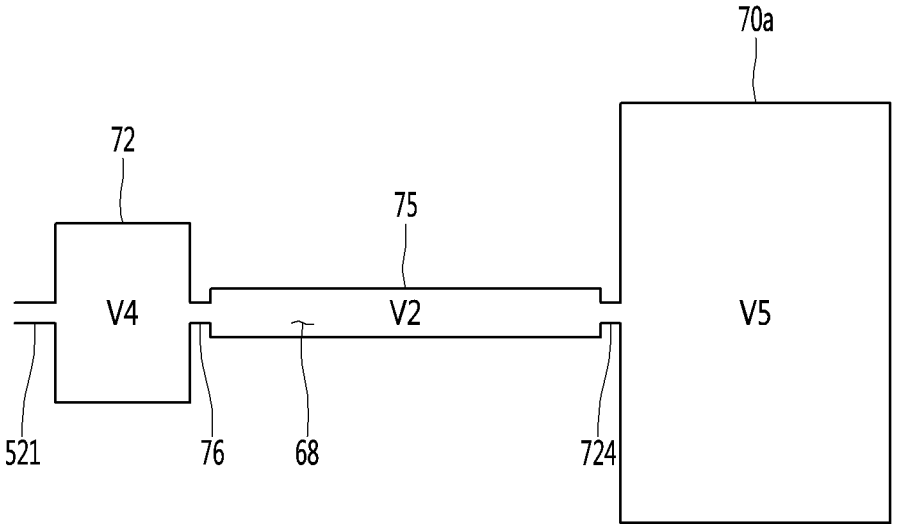
FIG. 8 is a view for explaining a principle of reducing noise by the upper muffler and the noise reducing unit according to the second embodiment of the present disclosure.

FIG. 6 is a perspective view illustrating a state in which a noise reducing unit is installed inside an upper muffler according to a second embodiment of the present disclosure, and FIG. 7 is a view illustrating a state in which the noise reducing unit of FIG. 6 is separated from the upper muffler. FIG. 8 is a view for explaining a principle of reducing noise by the upper muffler and the noise reducing unit according to the second embodiment of the present disclosure.

In the present embodiment, other components are identical to those according to the first embodiment, but only a location of the noise reducing unit is different from that according to the first embodiment. Thus, only characteristic parts according to the present embodiment will be described below.

Referring to FIGS. 6 to 8, the noise reducing unit 75 according to the present embodiment may be installed in an internal space of the upper muffler 72.

The upper muffler 72 may include a seating plate 720 seated on the upper bearing 52 and a chamber defining part 722 extending upward from the seating plate 720 and defining a predetermined space in an interior thereof.

The noise reducing unit 75 may be fixed to the chamber defining part 722 by welding while being accommodated in the chamber defining part 722.

The noise reducing unit 75 may include a chamber defining body 751 defining the noise reducing chamber 68. In the present embodiment, because a basic structure of the chamber defining body 751 is the same as that of the chamber defining body 651 according to the first embodiment, detailed descriptions thereof will be omitted.

In a state in which the chamber defining body 751 is fixed to the upper muffler 72, the noise reducing chamber 68 is defined by an upper surface of the chamber defining part 722 and the chamber defining body 751. In a state in which the noise reducing unit 75 is fixed to an inside of the upper muffler 72, a lower surface of the noise reducing unit 75 is spaced apart from the upper surface of the upper bearing 52.

An inlet 76 through which noise is to be introduced may be formed in the chamber defining body 751. Of course, the refrigerant may be introduced through the inlet 76.

An outlet 724 through which the refrigerant introduced into the noise reducing chamber 68 is to be discharged may be provided on an upper surface of the upper muffler 72.

In this case, one or more outlets through the refrigerant is directly discharged to an inside of the shell 10 while being not introduced into the noise reducing chamber 68 may be provided on the upper surface of the upper muffler 72.

In the present embodiment, the discharge port 521 of the upper bearing 52 and the internal space (volume V4) of the upper muffler 72 serve as a first resonator.

Further, the inlet 76 of the noise reducing unit 75 and the noise reducing chamber 68 (volume V2) serve as a second resonator.

Further, the outlet 724 of the upper muffler 72 and a space 70*a* (volume V5) between the outer surface of the upper muffler 72 and the lower surface of the driving motor 20 in the shell 10 serve as a third resonator.

That is, the discharge port 521, the inlet 76 of the noise reducing unit 75, and the outlet 724 of the upper muffler 72 serve as neck parts of the resonators, respectively, and the internal space of the upper muffler 72, the noise reducing chamber 68, and the internal space 70*a* of the shell 10 serve as volume parts of the resonators, respectively.

In this case, the volume V4 of the internal space of the upper muffler 72 is a volume obtained by subtracting the volume of the noise reducing unit 75 from the volume of the internal space itself of the upper muffler 72. In this case, the volume V4 of the internal space of the upper muffler 72 may be larger than the volume of the noise reducing chamber 68.

In the present disclosure, the first resonator to the third resonator may be designed to reduce noise having different frequency bands.

Even according to the present embodiment, there is an advantage in that the noise reducing unit is installed inside the upper muffler, so that noise having a frequency band that is different from a frequency band of the noise reduced by the upper muffler may be reduced.

Further, according to the present disclosure, the resonators may be formed by designing the length of the noise reducing unit 75 and the cross-sectional area of the noise reducing chamber 68 without changing structures of other parts of the conventional compressor, and then coupling the noise reducing unit 65 and the noise reducing chamber 68 to the upper muffler 72. Thus, according to the present disclosure, the resonators for reducing noise may be formed without a change in the existing structure.

In particular, because the internal space of the shell serves as the volume part, an effect that two additional resonators are formed in the resonator is obtained by the upper muffler when the noise reducing unit is coupled to the upper muffler. Thus, there is an advantage in that the plurality of resonators may be formed through a simple structure.

Figure 9:
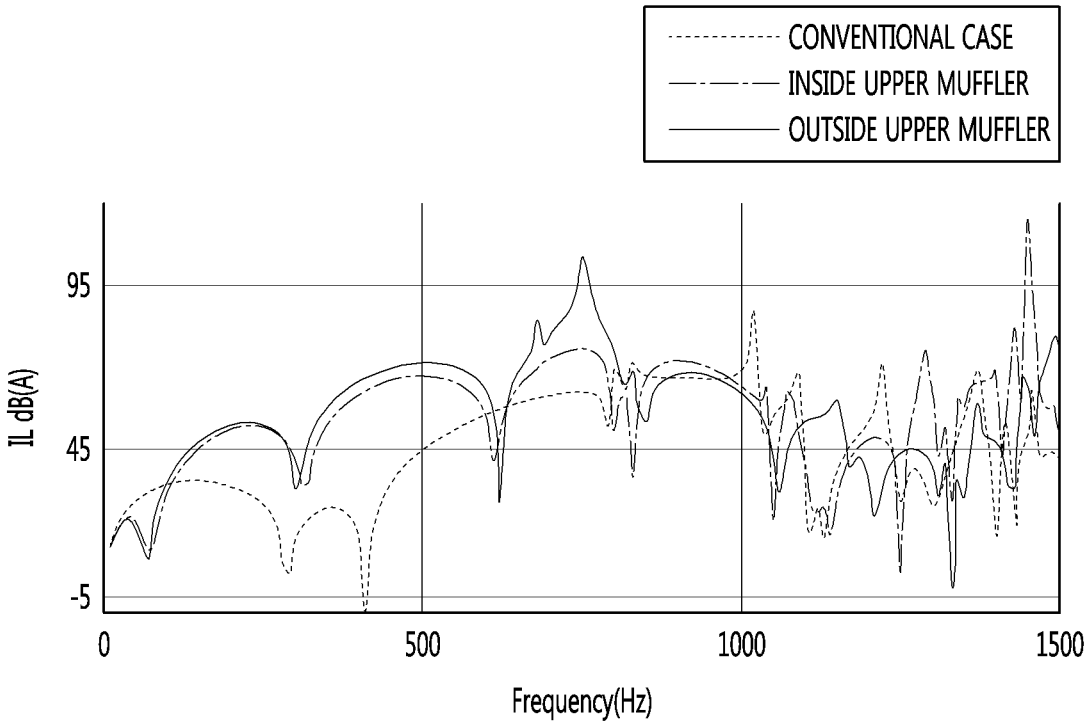
FIG. 9 is a graph depicting comparison between noise reduction degrees according to existence of the noise reducing unit according to the embodiments of the present disclosure.

FIG. 9 is a graph depicting comparison between noise reduction degrees depending on existence of the noise reducing unit according to the embodiments of the present disclosure.

In FIG. 9, a horizontal axis corresponds to a frequency and a vertical axis corresponds to a noise reduction degree (transmission loss) for each frequency.

Referring to FIG. 9, it can be identified that when the noise reducing unit exists outside or inside the upper muffler, a noise reduction degree (TL) for a frequency band of 1.5 KHz or less is large, as compared with the conventional upper muffler without the noise reducing unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. In addition, such modifications, additions and substitutions should not be separately determined based on the technical idea or prospect of the present invention.

What is claimed is:

1. A rotary compressor comprising:

a shell having a cavity formed therein;

a drive motor provided inside the cavity; and a compression unit to compress a refrigerant, the compression unit being powered by the driving motor, wherein the compression unit comprises:

a cylinder having a chamber formed therein in which the refrigerant is compressed;

a rotary shaft connected to the drive motor;

a roller provided in the chamber and connected to the rotary shaft to compress the refrigerant in the chamber;

a bearing coupled to the cylinder, the bearing having a discharge port through which the refrigerant that is compressed in the chamber passes;

a muffler coupled to the bearing and which receives the refrigerant that has passed through the discharge port; and a noise reducing unit attached to the muffler to define a noise reducing chamber together with the muffler, wherein the noise reducing unit comprises a chamber defining body that defines the noise reducing chamber, wherein the chamber defining body is coupled to the muffler and surrounds a circumference of the rotary shaft, wherein the chamber defining body comprises an inner side surface and an outer side surface, wherein each of the inner side surface and the outer side surface comprises a plurality of concave portions and a plurality of convex portions when viewed from above, and wherein the plurality of concave portions and the plurality of convex portions of each of the inner side surface and the outer side surface are alternately arranged.

2. The rotary compressor of claim 1, wherein a cross-sectional area of the noise reducing chamber is greater than a cross-sectional area of the discharge port.

3. The rotary compressor of claim 1, wherein the noise reducing unit is fixed to an outer side of the muffler, wherein the muffler comprises an opening through which noise and the refrigerant pass, and wherein the noise reducing unit comprises an outlet through which the refrigerant introduced into the noise reducing unit passes.

4. The rotary compressor of claim 3, wherein the muffler comprises an outlet through which the refrigerant passes.

5. The rotary compressor of claim 1, wherein the muffler comprises an internal space and the noise reducing unit is located inside the internal space of the muffler, wherein the noise reducing unit comprises an inlet through which noise and the refrigerant pass, and wherein the muffler comprises an outlet through which the refrigerant having flowed through the noise reducing unit passes.

6. The rotary compressor of claim 5, wherein the volume of the noise reducing unit subtracted from the volume of the internal space of the muffler is greater than the volume of the noise reducing chamber.

7. The rotary compressor of claim 5, wherein the muffler comprises a second outlet through which refrigerant not introduced into the noise reducing unit passes.

* * * * *